US005749479A

United States Patent [19]

Belokin et al.

[11] Patent Number: 5,749,479

[45] Date of Patent: May 12, 1998

[54] DISPLAY ASSEMBLY

[76] Inventors: Paul Belokin; Martin P. Belokin; Norman P. Belokin, all of P.O. Box 1907, Denton, Tex. 76202

[21] Appl. No.: 588,547

[22] Filed: Jan. 18, 1996

[51] Int. Cl.[6] ..... A47F 5/00

[52] U.S. Cl. ..... 211/113; 211/117; 211/118

[58] Field of Search ..... 211/113, 117, 211/118, 86.01; 248/340, 341

[56] References Cited

U.S. PATENT DOCUMENTS

| | | | |
|---|---|---|---|
| 1,738,030 | 12/1929 | Bebb | 211/118 X |
| 2,714,965 | 8/1955 | Fitzkee et al. | 211/113 |
| 4,108,084 | 8/1978 | Fink | 211/117 X |
| 4,765,495 | 8/1988 | Bisk | 211/113 |
| 4,872,568 | 10/1989 | Lehmann | 211/113 |

*Primary Examiner*—Robert W. Gibson, Jr.
*Assistant Examiner*—Sarah L. Purol
*Attorney, Agent, or Firm*—Jack A. Kanz

[57] ABSTRACT

A display assembly is designed to display goods in the unused air space above counters, for example, by attaching the assembly to the supports of a drop-style ceiling. The display assembly includes a bracket which attaches between two supports as well as a display for folding sellable merchandise. The display can be attached to the bracket by any suitable means including monofilament or chains. The displays can include space for signage. By suspending the display assembly from the ceiling, the user can utilize air space previously wasted. Further, the displays are free to sway gently in response to any breeze, thereby attracting attention.

28 Claims, 7 Drawing Sheets

DISPLAY ASSEMBLY

TECHNICAL FIELD OF THE INVENTION

The present invention relates to a display assembly used to display goods at convenience stores or other retail establishments. In one embodiment, the display assembly suspends the goods from the ceiling of the store thereby utilizing formerly unused space.

BACKGROUND OF THE INVENTION

Convenience stores are highly evolved in the art of displaying goods to customers. The store typically has several isles of dry goods and a number of refrigerated sections behind glass doors. The isles are rarely over four to five feet in height. Additionally, there is typically ample counter space for coffee machines, doughnuts, and cold drink dispensers. Despite industry efforts, however, there is a substantially large area not being utilized in such stores for the display of goods. A need exists for a display assembly which can hold sellable goods in the air space above counters and elsewhere.

Convenience stores typically have drop style suspended ceilings. This system uses a grid of supports which span across the ceiling. FIG. 1 illustrates such a ceiling 10. The ceiling 10 includes a plurality of parallel supports 12. Each support is suspended with a wire 18 from the building's roof (not shown). The supports 12 are generally a T-shape having a horizontal portion 16 and a vertical portion 14. A grid of such supports is constructed below various physical plant features such as pipes and air conduits. Ceiling tiles 20 are then supported on the grid. The spacing of grid supports 12 is standardized. For example, one popular system has rectangular openings which are sized to accept 24"×48" tiles, while another feature 24" square tiles.

Several hook systems have been developed to grasp the ceiling support 12. However, none have proved satisfactory, lacking either adequate strength and/or stability. For example, FIGS. 12, 13 and 14 illustrate various prior art hooks. FIG. 12 illustrates a simple clasp 30 which envelopes the horizontal portion 16 of a support 12. Flanges 32 are shaped to grip the horizontal portion 16. The clasp 30 can be deformed to spread the sides 34 apart slightly to allow installation of the clasp. A hole 36 is provided in each side 34 for attachment. FIG. 13 illustrates a prior art hook 40 which also attaches to the horizontal portion 16 of a support 12. Again, flanges 42 are shaped to grip the support. Force 48 is applied to the tabs 44 as shown to spread the flanges apart for installation. Material can then be hung from curve 46. FIG. 14 illustrates a third fastener 50 formed by two adjacent hook shaped pieces 54, 56. Each piece has a flange 52. Both are attached by pin 58 which allows the pieces 54, 56 to pivot open, allowing the fastener to be installed to a support 12.

The prior art devices described all suffer from the same drawbacks; each is flimsy and unstable. A need exists for a device that allows the stable display of sellable goods in the dead space in corners, above countertops and the like. This improved display system should be stable and yet flexible enough to adapt to a particular store's needs.

SUMMARY OF THE INVENTION

This invention relates to suspending a display shelf with product presentation at eye level to a customer in a place of business where traffic flow is busiest. This invention relates to a means of presentation of new or old products, hanging in space, and supported from a ceiling for easy access to a customer. Most often, this display will be hung over areas like counters, where high traffic occurs, but where there is no more space available. This display assembly is advantageous to a store owner because it allows him to take advantage of air space that previously was never used. He can present more products, which means more profits. In the past there has been signage and displays hanging from the ceiling—balloons, paper, plastic foam or blow-up displays that hold no sellable products. They hang from small hooks such as those described above and are designed to hold light objects such as signs and small displays. This type of display was not built, nor was it intended to hold sellable merchandise.

This new system, in conjunction with a variety of creative brackets, makes this product presentation possible. These brackets are designed to hold heavy merchandise and be securely attached to hung ceilings. They attach in a variety of different positions to these ceilings and hung over counters and high traffic areas in the stores. They are designed to be flexible and move in all directions. When bumped by customer or store personnel, they will not cause injury. Another advantage is now they move when there is a slight wind or draft current. This attracts attention and it is well known in the retail industry that motion sells.

These product holding displays are attached to brackets by means of chain, wire, monofilament plastic line, rope, or any strong hanging material. The shelving can be constructed of cardboard, plastic, wire, or other suitable material depending on the weight of the product being sold. Many sales by retail outlets are made by impulse. This requires better fixture displays that can be seen at eye level for easier customer examination. Further, the introduction of new products can now be awarded a trial space in front of the consumer rather than be placed on bottom shelves or in the back of the store.

BRIEF DESCRIPTION OF THE DRAWINGS

For a more complete understanding of the present invention, and for further details and advantages thereof, reference is now made to the following Detailed Description taken in conjunction with the accompanying drawing, in which.

DETAILED DESCRIPTION OF THE DRAWINGS

Figures 1, 2:
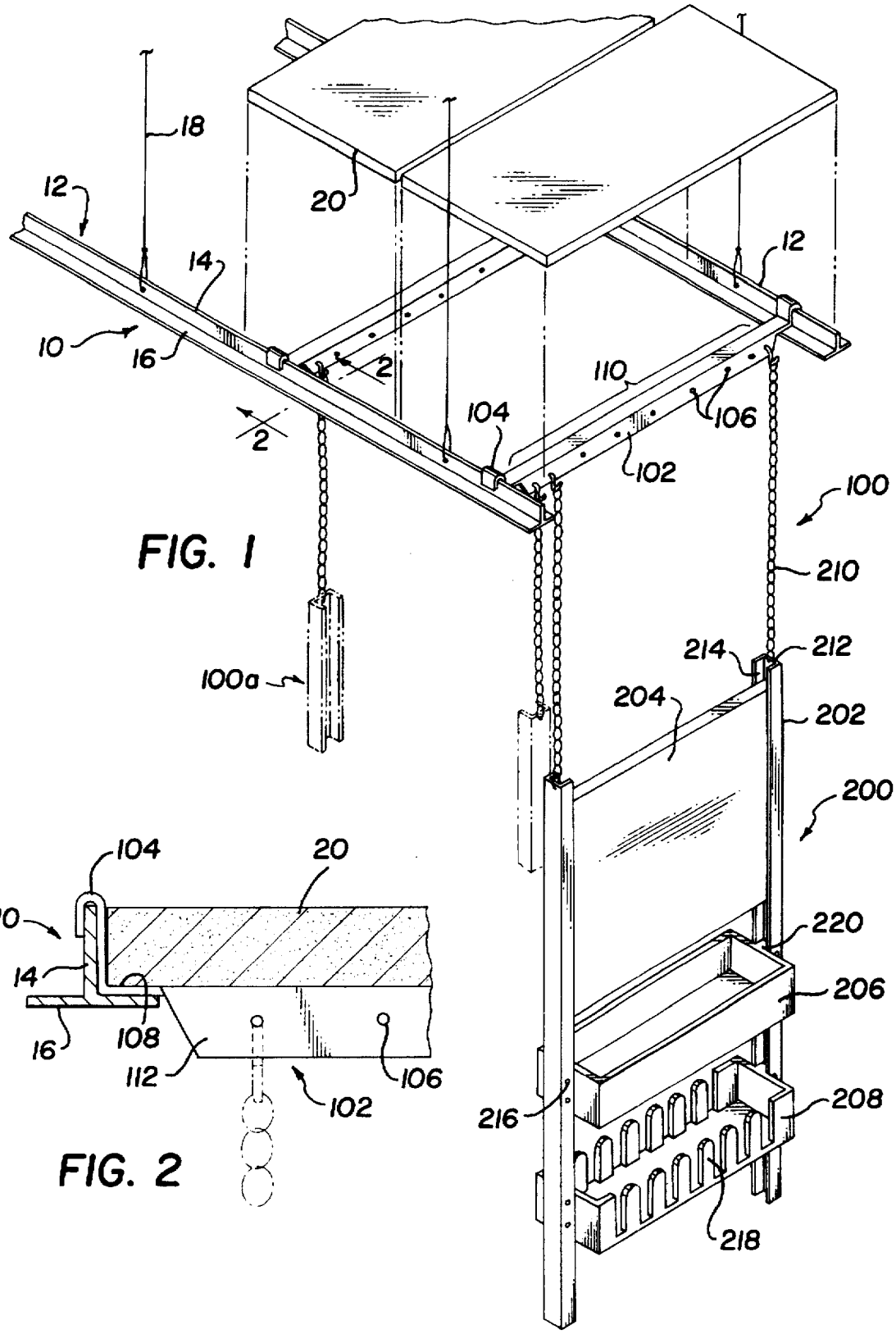
FIG. 1 is an exploded view of a hung ceiling showing one embodiment of the display assembly.
FIG. 2 is a side sectional view across section lines 2—2 in FIG. 1.

The present invention relates to a display assembly that overcomes many of the disadvantages found in the prior art. Referring to FIGS. 1 and 2, an exemplary display assembly 100 is shown attached to a drop-style ceiling 10. The display assembly 100 includes a bracket 102 and a display 200. The bracket 102 is shaped to engage the supports 12 of the ceiling 10 with hooks 104. The bracket 102 has a plurality of holes 106 from which the display 200 can be hung. The holes 106 are formed in a downward extending side 112. The bracket 102 is preferably made out of any metal or other material having suitable weight and strength properties. A display 200 can be hung under one bracket 102 or between two brackets as shown in phantom as 100*a*.

Each bracket 102 has a span 110 which is dimensioned to match the spacing between two supports 12. As discussed above, standard drop-style ceilings have supports spaced either two or four feet apart. The end 108 of the span 110 overlaps onto the horizontal portion 16 of the support 12. Additionally, a hook 104 on each end of the bracket 102 is dimensioned to overlap the vertical portion 14 of the support 12. The combination of the hook 104 and overlap portion 108 secures the bracket 102 to the support 12. Ceiling tiles 20 are typically cut to fit between the vertical portions 14 with some tolerance. The presence of the bracket 102 should not interfere with the placement of the ceiling tile 20. If necessary, the tile can be trimmed.

Figure 3:
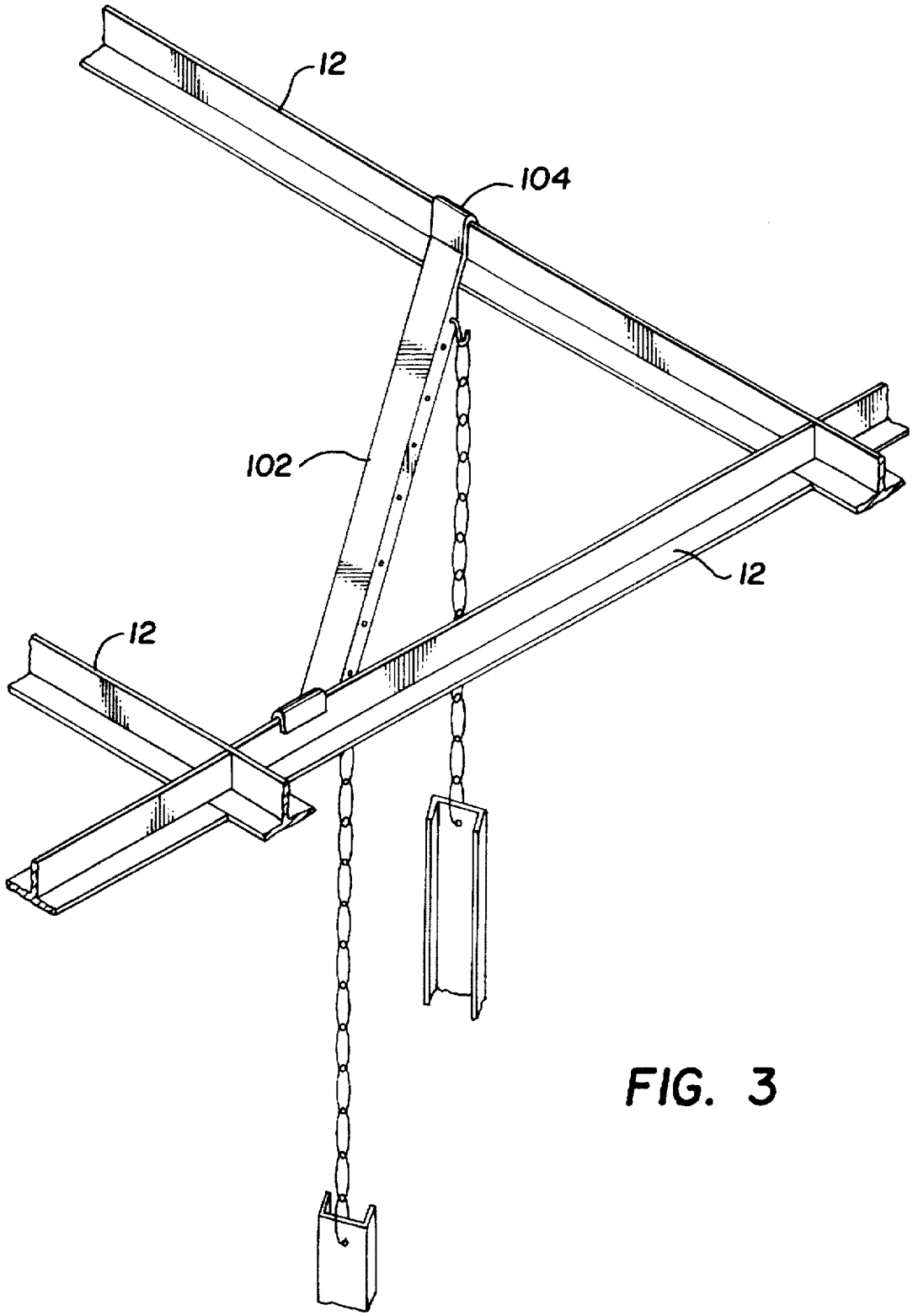
FIG. 3 is a perspective view of another embodiment of the display assembly suitable for corners.

FIG. 3 illustrates a gridwork of supports 12. The bracket 102 differs only in that the hooks 104 are angled relative to the span. For example, as illustrated, the hooks 104 are angled by forty-five degrees. This allows the bracket 102 to span between two perpendicular supports 12. This configuration allows the display assembly to be used in a corner. Of course, the angle of the hook 104 can be changed to create any desired angle of the display assembly.

Figure 4:
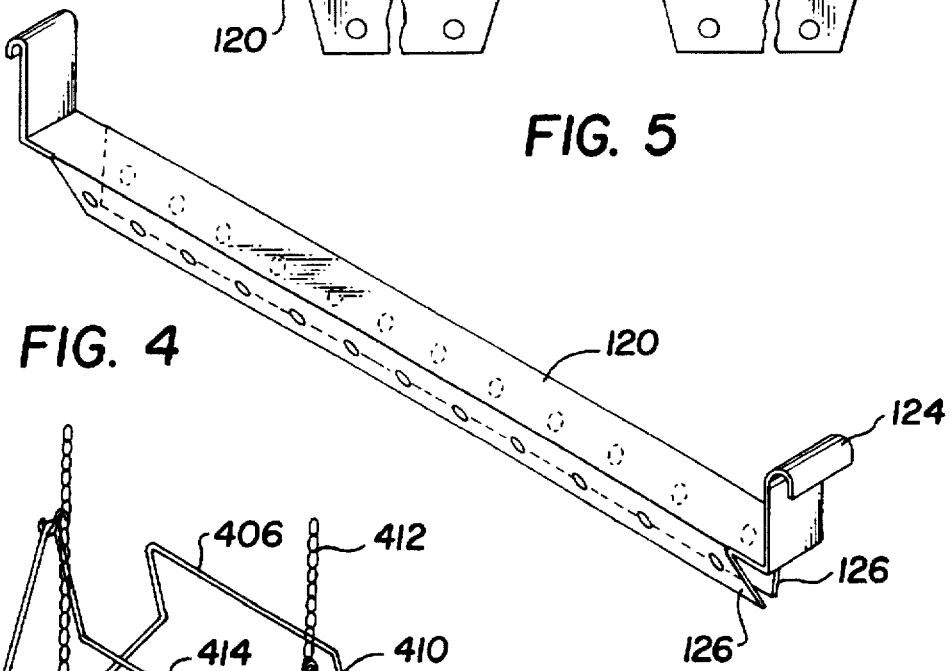
FIG. 4 is a perspective view of another embodiment of the display assembly.
Figure 7:
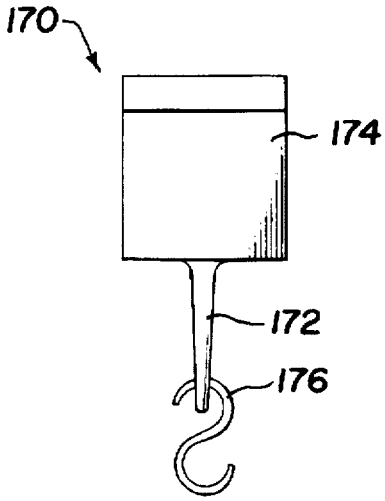
FIG. 7 is a side view of another embodiment of a display bracket.

FIGS. 4, 5, 7, 8, 9, 10, 11, and 22 show various embodiments of the bracket. Each is configured to engage a support 12 in a drop-style ceiling 10. FIG. 4 illustrates a bracket 120 with two opposed sides 126. Both sides can be bent inward to center the load under the bracket. By centering the load, any torque experienced by the hooks 124 is minimized. FIG. 7 accomplishes the same by having a single plane 172 of material centered under the span of the bracket 170. Again, this minimizes the torque experienced by the hooks 174. A plurality of holes allow for the attachment of hanging means 176 which include hooks, chain, wire, monofilament plastic line, rope, or any strong hanging material.

Figure 5:
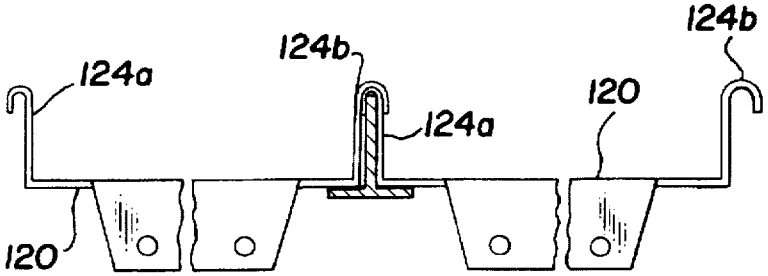
FIG. 5 illustrates yet another embodiment wherein the hook portions of sequentially installed display brackets overlap.

FIG. 5 shows two brackets 120 installed end-to-end to allow for a wider display underneath, or several displays side-by-side. To accomplish this, one bracket 124*a* can be slightly shorter than the overlapping hook 124*b*. This design would allow for any number of brackets to be installed end-to-end.

Figure 8:
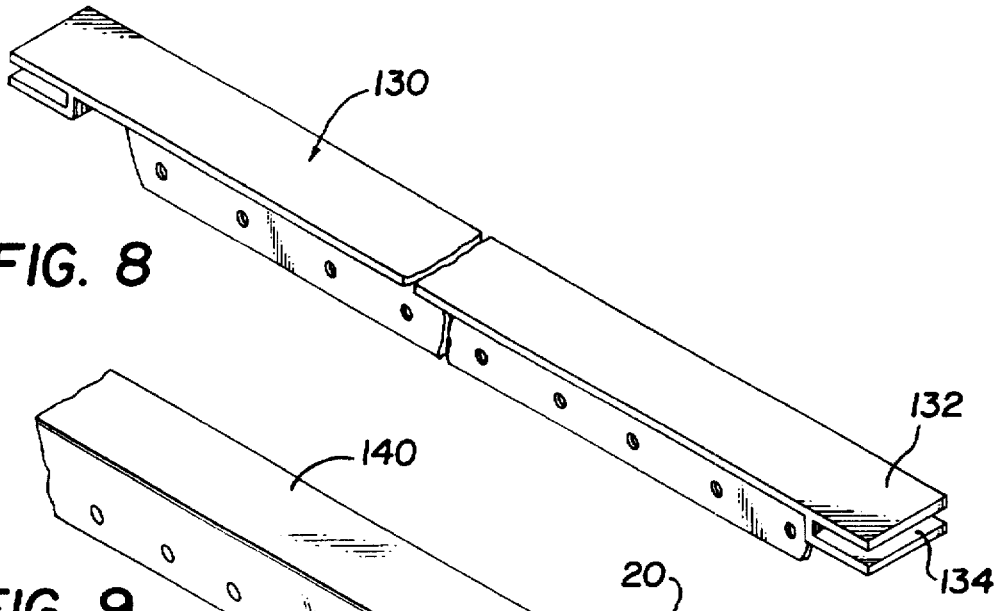
FIGS. 8 to 11 illustrate various embodiments of the bracket.
Figure 9:
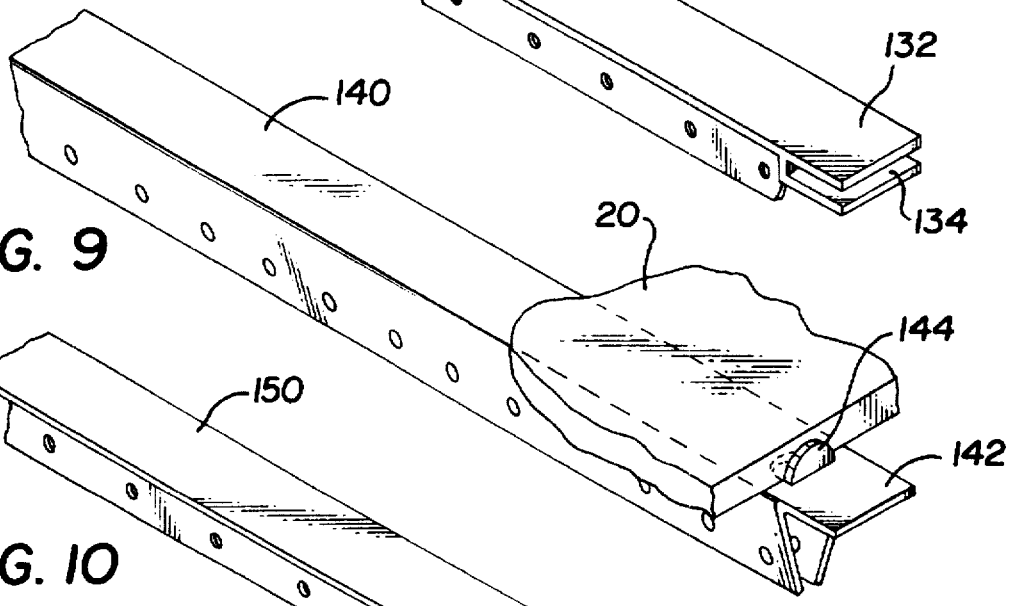
Figure 10:
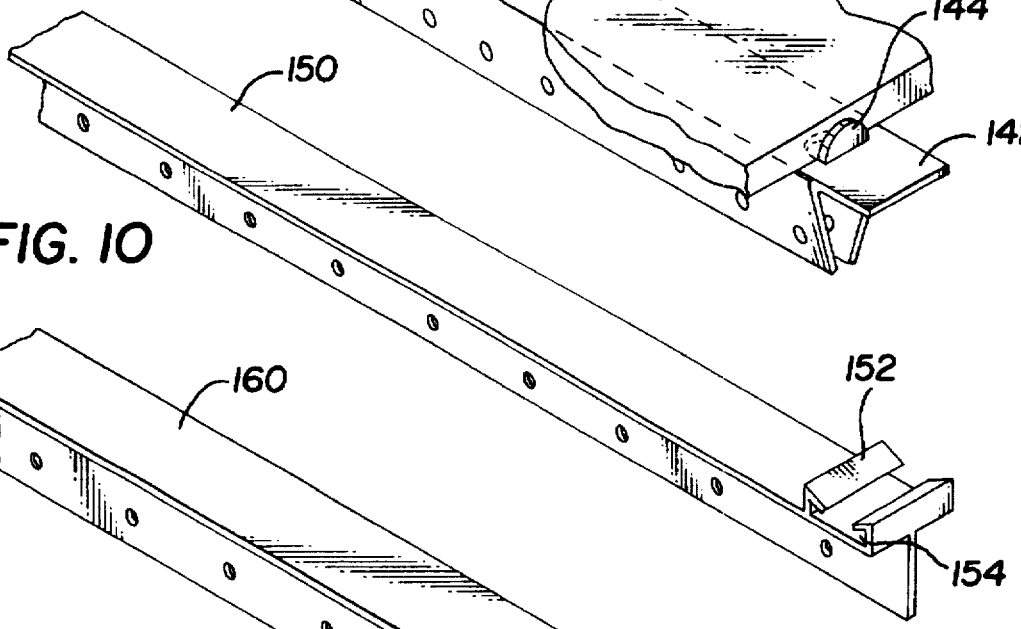
Figure 11:
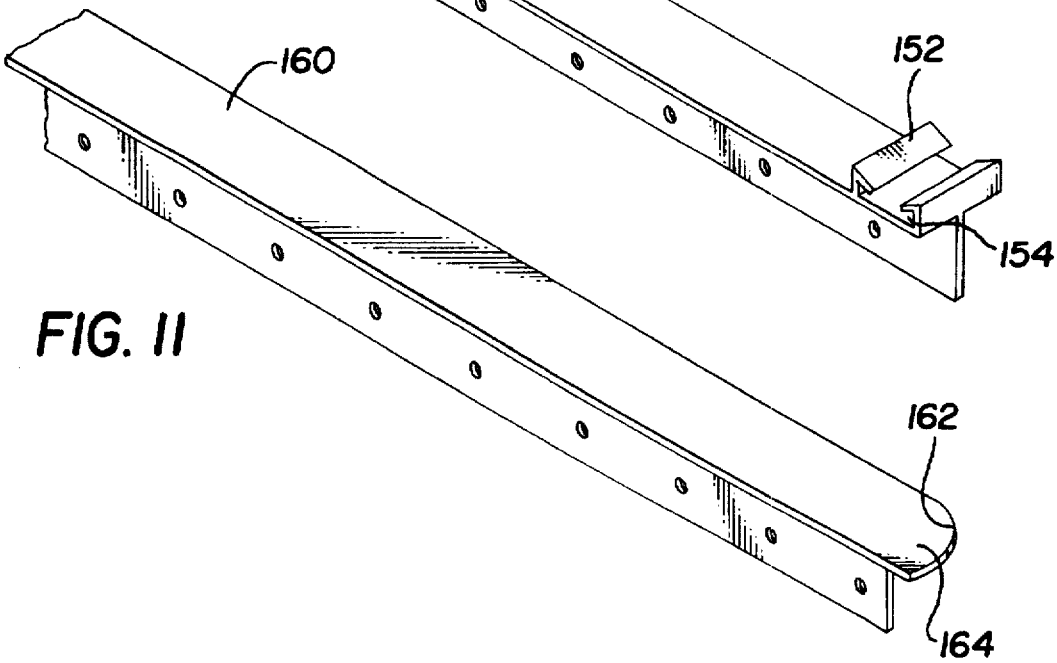
Figure 12:
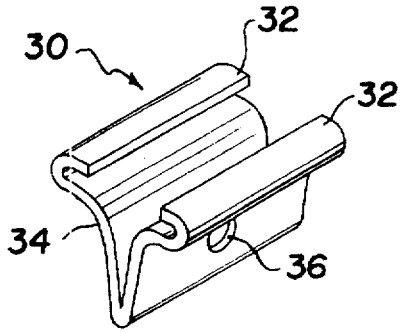
FIG. 12 (PRIOR ART)
FIGS. 12 to 14 illustrate prior art hangers.
Figure 13:
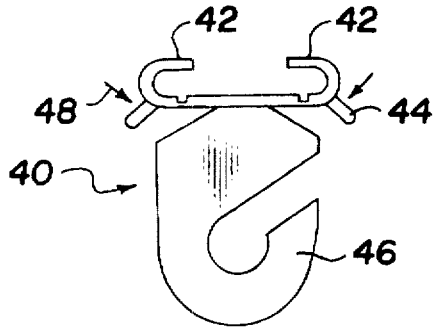
FIG. 13 (PRIOR ART)
Figure 14:
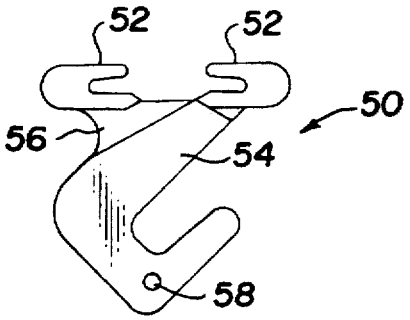
FIG. 14 (PRIOR ART)

FIG. 8 illustrates an alternative bracket 130 which attaches to the support 12 with channeled edge 132. The horizontal portions 16 of spaced supports 12 fit into the channel 134 on each end of the bracket 130. In FIG. 9, the bracket 140 has a flange 142 which overlaps the horizontal portion 16 of the support 12. Further, the upper surface of the bracket 140 has an upwardly extending notch 144 which acts as a stop for ceiling tile 20. This is particularly useful at the edge of a ceiling assembly 10 which does not have a perpendicular support to provide a stop. FIG. 10 illustrates a bracket 150 having a clip 152 for attachment to the horizontal portion 16 of a support 12. The clip 152 has a channel 154. When attached the clip envelopes the horizontal portion 16 in channel 154. FIG. 11 illustrates another embodiment of the bracket 160 having an overlap portion 164 which rests on the horizontal portion 16 of a support 12. However, the overlap portion 164 has a curved edge 162. This feature is particularly helpful when the bracket must be rotated into position in a corner.

Figure 22:
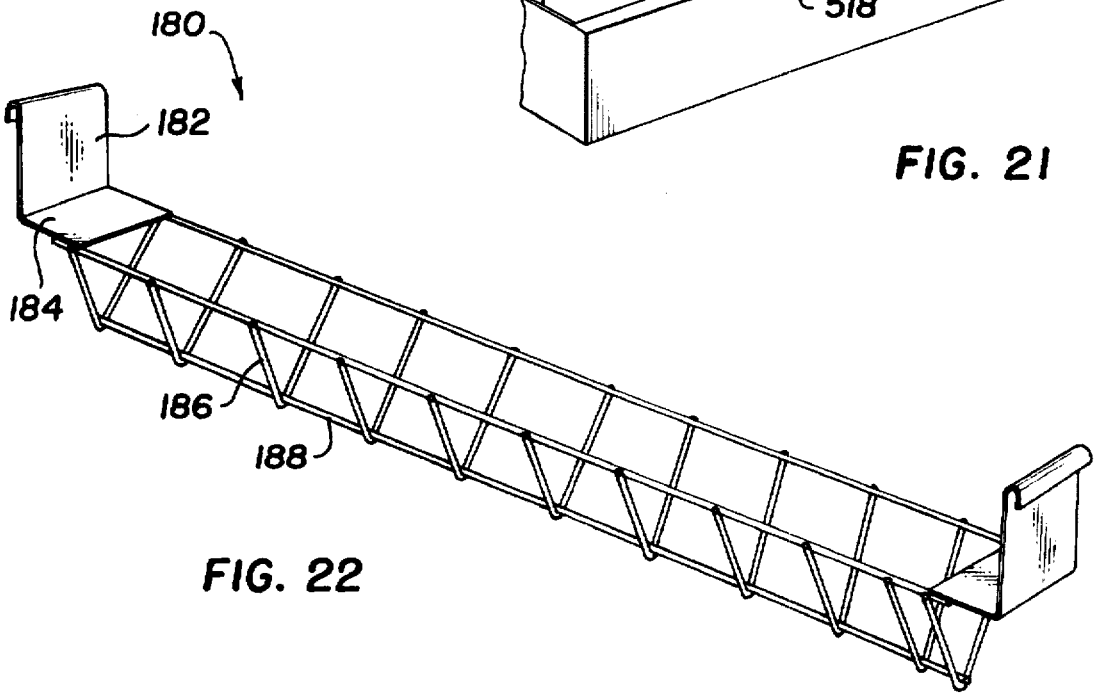
FIG. 22 illustrates a alternative bracket design.

FIG. 22 illustrates a bracket 180 which has a grid of spaced wires 186 across its span 188. This trellis style provides strength while minimizing the weight of the bracket. This style is particularly useful for longer spans. As illustrated, the bracket 180 has a flange 184 which overlaps the horizontal portion 16 of a support 12 while the hook 182 fits over the vertical portion 14. Each bracket described provides a stable platform from which to hang a display. Each is configured to securely attach to a drop-style ceiling, and can be lengthened or shortened to meet the needs of the situation.

FIGS. 1, 6, 16, 20, and 21 illustrate a display which can be suspended from any of the brackets discussed above. FIG. 1 shows a display 200 which hangs from bracket 102. The display 200 has a frame 212 formed by two opposed members 202. Each frame member 202 has a channel 214. Signage 204 can be placed between the frame members 202. The signage 204 can contain advertising, pricing information or other eye-catching material. At least one product container 206, 208 can also be placed into the frame 212. The signage 204 and containers 206, 208 can be attached to the frame 212 by any suitable fastener 216. One container 206 can be an open box for holding products such as candybars. Another style of container 208 has fingers 218 which allow the product to be easily grasped and removed by a customer. Each style of container 206, 208 has a portion 220 which fits within the channel 214 of frame member 202. A fastener 216 can then attach the product container 206, 208 to the frame 212. Of course, the order and style of container 206, 208 and signage 204 can be varied to meet the needs of the situation. The whole display hangs from a bracket 102 by means of a chain 210. Any suitable hanging means could be used.

Figure 6:
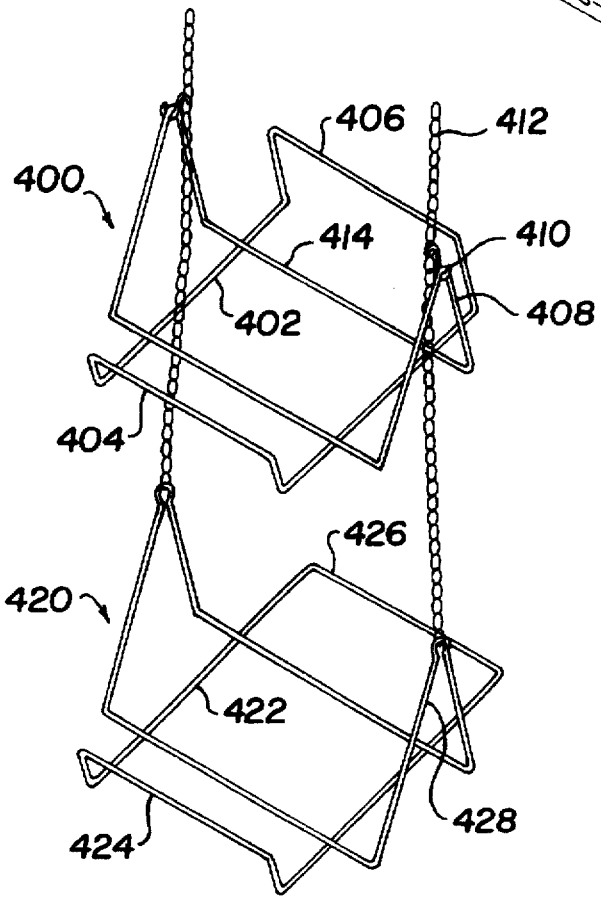
FIG. 6 provides a perspective view of one product display that can be suspended from the brackets.
Figure 16:
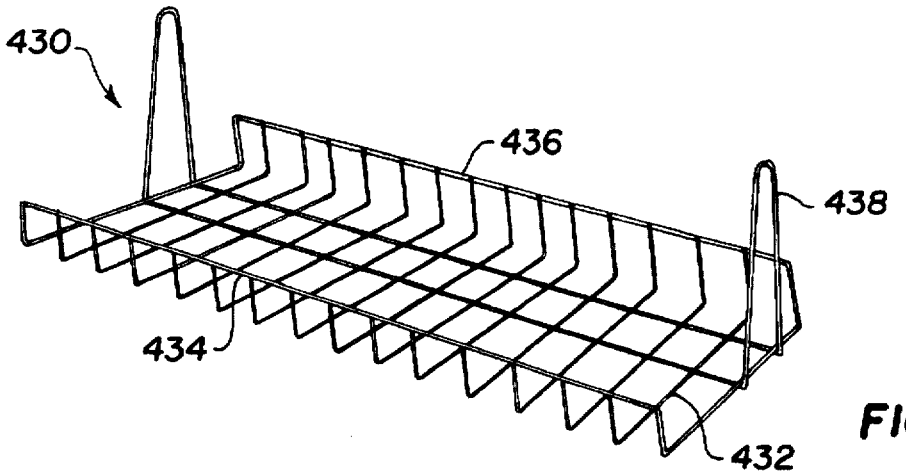
FIG. 16 illustrates an alternative embodiment of a display.

Referring to FIGS. 6 and 16, three different displays are illustrated which can be suspended from a bracket. Display 400 is a formed wire assembly having a base 402. The base 402 has a forward lip 404 and a back stop 406. Sides 408 are also formed and attached to the base 402. The display 400 can be attached to hanging means 412 by any suitable means 410 and at any suitable height. The sides 408 are formed by a looped wire with a section 414 which supplements the base 402. Products such as candy bars come from the manufacturer in rectangular cardboard boxes. Thus, the display 400 is shaped to accept this boxed product. Once the package lid is removed, customers can simply remove the displayed product. Further, most boxes carry the product logo and colors. This ready advertising is plainly visible through the display. Display 420 is similar in structure to display 400. Display 420 has sides 428 and a base 422. While the base 422 has a forward lip 424, its back 426 does not form a stop. The display 430, shown in FIG. 16, is also similar to display 400, except that the base has numerous cross-pieces 432. This design is advantageous for displaying loose items.

Figure 20:
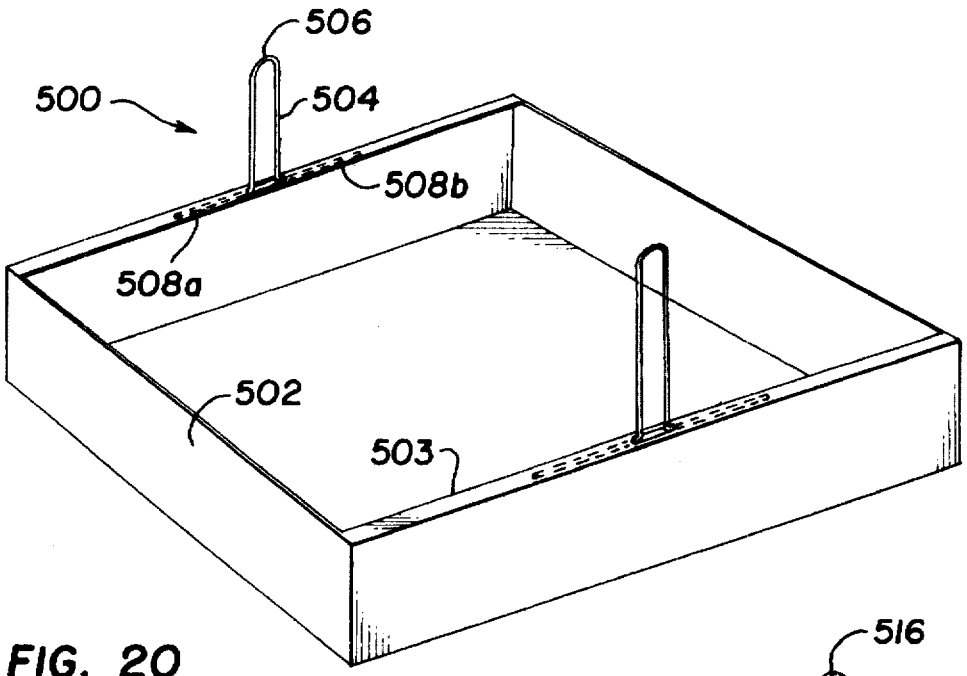
FIGS. 20 and 21 show an alternative product display.
Figure 21:
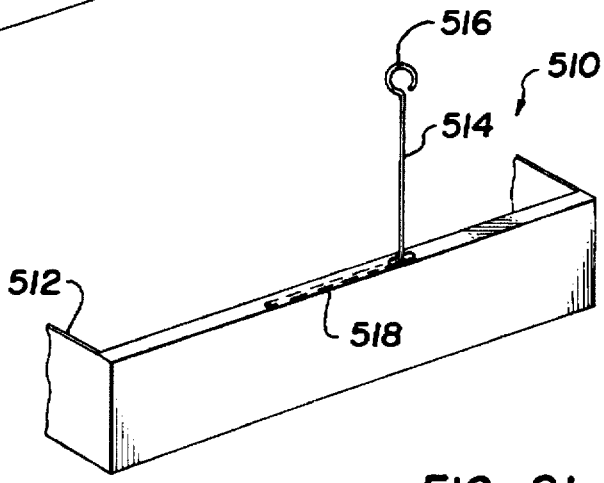

FIGS. 20 and 21 illustrate an alternative display design. Display 500 is generally a box 502 having specially shaped clips 504 that extend upwards from the display sides. Each clip 504 has an apex 506 and lengths 508*a*, 508*b*. The lengths 508*a*, 508*b* extend both forward and rearward along the side of the box 502. The clips 504 can be captured in the construction of the box 502. Alternatively, the box 502 can have a lip 503 under which the clip 504 sets. Display 510 is similar in construction with the exception that the clip 514 only has a single length 518 which extends forward along the side of the box 512.

Figure 15:
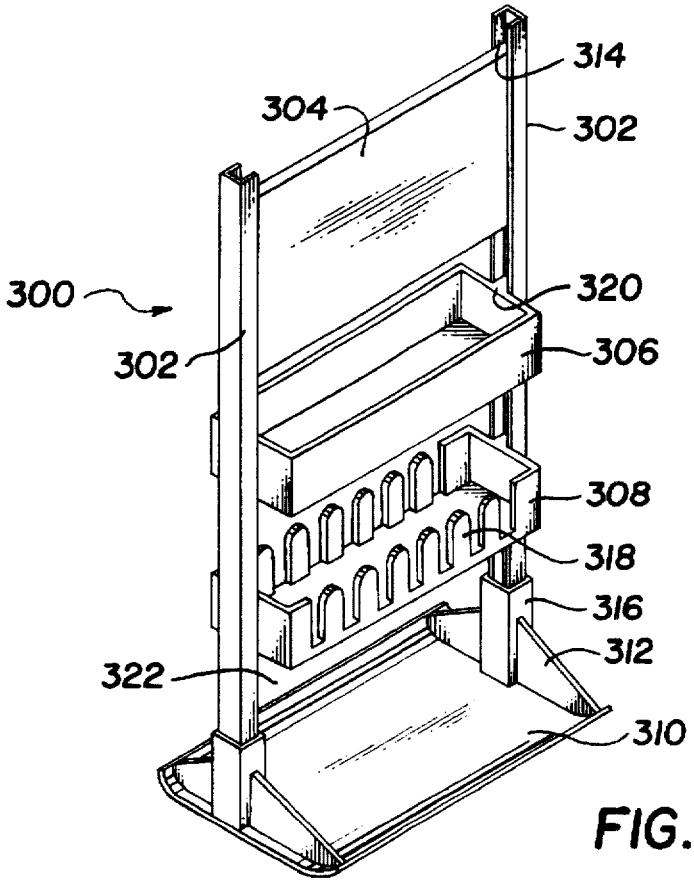
FIG. 15 illustrates an embodiment having a base which supports merchandise above a counter.

FIG. 15 illustrates a free-standing display 300 that securely places sellable merchandise above other articles on a counter or floor. Unlike the styles discussed above, this display assembly does not use a bracket and is not hung from the ceiling. The display 300 has a frame 302 formed by two opposed members 302. Each frame member 302 has a channel 314. The frame members 302 fit into a base 310. The base 310 has receptacles 316 to receive the frame members 302. The receptacles 316 can be buttressed by flanges 312. Signage 304 can be placed between the frame members 302. Again, the signage 304 can contain advertising, pricing information or other eye-catching material. At least one product container 306, 308 can also be placed into the frame. The signage 304 and containers 306, 308 can be attached to the frame by any suitable fastener. The containers 306 and 308 can be various configurations. Each style of container has a portion 320 which fits within the channel 314 of frame member 302. A space 322 separates the bottom container 308 and the base 310. In use, this display 300 is useful on a cluttered counter. For example, if a coffee machine is on the counter, the coffee machine can be placed on the base 310 and related products can be placed in the product containers 306, 308. For example, a convenience store might place danish or pastries above the coffee machine in an effort to increase sales. Without a display assembly such as those described above, these sellable products would be further from the buyer's view.

Figure 17:
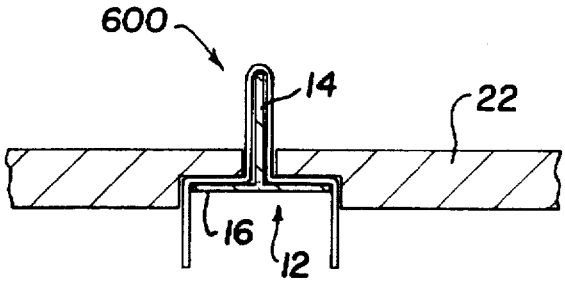
FIGS. 17 to 19 illustrate a saddle clip which can be used as a bracket.
Figure 18:
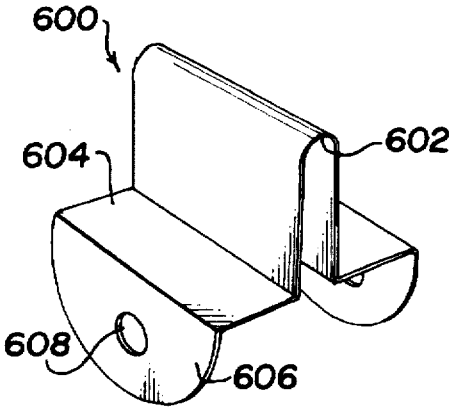
Figure 19:
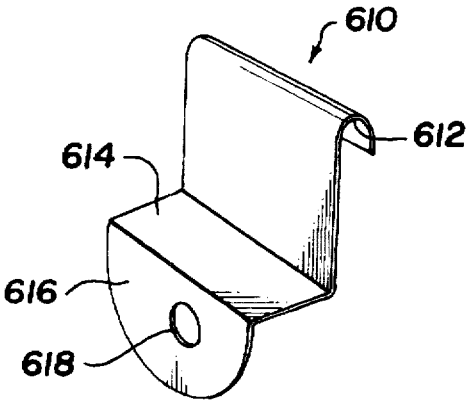

FIGS. 17, 18, and 19 illustrate a saddle clip which can be used to anchor a display structure to a drop style ceiling. The ceiling shown has a support 12 with a horizontal portion 16 and a vertical portion 14. The tile 22 is a variation which is grooved to extend slightly below the support 12. The saddle clip 600 overlaps the vertical portion 14 of the support 12 and has two flanges 604 which rest on the upper surface of the horizontal portion 16. The apex 602 of the clip 600 can also contact the top of the ceiling support 12. The flanges 604 turn downward to form an attachment surface 606. A hole 608 penetrates this surface 606. Saddle clip 610 is similar with the exception that the clip only partially covers the support 12. This style is superior to prior art clips. For clip 600 to fail, its material must literally tear or the support 12 fail. Prior art clips could easily disengage the support if merely bumped.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the invention.

We claim:

1. A display assembly for suspension from a ceiling having a grid of supports for accepting ceiling tiles, and wherein said supports have a horizontal portion and a vertical portion, said assembly comprising:

(a) a bracket having first and second ends, said ends having a flange which overlaps the horizontal portion of the ceiling supports; and (b) a display attached to the bracket by hanging means.

2. The display assembly of claim 1 wherein said bracket further comprises a span having a plurality of holes therethrough.

3. The display assembly of claim 2 wherein said plurality of holes are evenly spaced.

4. The display assembly of claim 1 wherein said bracket has a first and second side bent inward to center a load under said bracket.

5. The display assembly of claim 1 wherein said bracket comprises a span having a single plane centered under the span, wherein said plane has a plurality of holes.

6. The display assembly of claim 1 wherein a first and second hook shaped to overlap the vertical portion of the ceiling supports is coupled to said flange of said first and second end of said bracket.

7. The display assembly of claim 6 wherein said first hook is shaped to overlap the second hook of an adjacent bracket.

8. The display assembly of claim 1 wherein said flange is a channeled edge shaped to engage the horizontal portion of the ceiling support.

9. The display assembly of claim 1 wherein each of said flanges has a curved edge surface.

10. The display assembly of claim 1 wherein said bracket further comprises an upwardly extending notch which acts as a stop for said ceiling tile.

11. The display assembly of claim 1 wherein said bracket has a span formed by a grid of spaced wires.

12. The display assembly of claim 1 wherein said display further comprises an advertising placard.

13. The display assembly of claim 1 wherein said display comprises a formed wire assembly having a base with a forward lip.

14. The display assembly of claim 13 wherein said display further comprises a back stop.

15. The display assembly of claim 1 wherein said display comprises a box with sides and clips attached thereto, said clips extending upwards from the display sides.

16. The display assembly of claim 1 wherein said hanging means are flexible such that the display will sway when subjected to a lateral force.

17. A display assembly for suspension from a ceiling having a grid of supports for accepting ceiling tiles, and wherein said supports have a horizontal portion and a vertical portion, said assembly comprising:

(a) a bracket having first and second ends, said ends having a clip for attachment to the horizontal portion of the ceiling supports; and (b) a display attached to the bracket by hanging means.

18. A display assembly as defined in claim 17 wherein said bracket further comprises a span having a plurality of holes therethrough.

19. A display assembly as defined in claim 18 wherein said plurality of holes are evenly spaced.

20. A display assembly as defined in claim 17 wherein said bracket has first and second sides bent inwardly to center a load under said bracket.

21. A display assembly as defined in claim 17 wherein said bracket comprises a span having a single plane centered under the span, wherein said plane has a plurality of holes.

22. A display assembly as defined in claim 17 wherein said bracket further comprises an upwardly extending notch which acts as a stop for said ceiling tile.

23. A display assembly as defined in claim 17 wherein said bracket has a span formed by a grid of spaced wires.

24. A display assembly as defined in claim 17 wherein said display further comprises an advertising placard.

25. A display assembly as defined in claim 17 wherein said display comprises a formed wire assembly having a base with a forward lip.

26. A display assembly as defined in claim 25 wherein said display further comprises a back stop.

27. A display assembly as defined in claim 17 wherein said display comprises a box with sides and clips attached thereto, said clips extending upwards from the display sides.

28. A display assembly as defined in claim 17 wherein said hanging means are flexible such that the display will sway when subjected to a lateral force.

* * * * *

UNITED STATES PATENT AND TRADEMARK OFFICE

CERTIFICATE OF CORRECTION

PATENT NO. : 5,749,479

DATED : May 12, 1998

INVENTOR(S) : Paul Belokin et al.

It is certified that error appears in the above-identified patent and that said Letters Patent is hereby corrected as shown below:

Column 3, line 35, "span" should read –supports 12--.
Column 3, line 44, "sides can" should read –sides 126 can--.
Column 3, line 45, "bracket." Should read –bracket 102.—
Column 5, line 13, "frame 302 formed" should read –frame formed--.

Signed and Sealed this

Twenty-eighth Day of July, 1998

Bruce Lehman

*Attest:*

BRUCE LEHMAN

*Attesting Officer*

*Commissioner of Patents and Trademarks*